US006401484B2

(12) United States Patent
Gano, III

(10) Patent No.: US 6,401,484 B2
(45) **Date of Patent: *Jun. 11, 2002**

(54) TRANSPORT CONTAINER

(76) Inventor: John Henry Gano, III, 170 Windview Pl., Alpharetta, GA (US) 30005

( * ) Notice: Subject to any disclaimer, the term of this patent is extended or adjusted under 35 U.S.C. 154(b) by 0 days.

This patent is subject to a terminal disclaimer.

(21) Appl. No.: 09/817,680

(22) Filed: Mar. 26, 2001

Related U.S. Application Data

(63) Continuation-in-part of application No. 09/409,319, filed on Sep. 30, 1999, now Pat. No. 6,216,487.

(51) Int. Cl.[7] ..... F25D 3/08
(52) U.S. Cl. ..... 62/457.5; 62/457.2
(58) Field of Search ..... 62/457.5, 457.2

*Primary Examiner*—William Doerrler
*Assistant Examiner*—Mark S. Shulman
(74) *Attorney, Agent, or Firm*—Thomas, Kayden, Horstemeyer & Risley, LLP

(57) ABSTRACT

Containers for transporting items are provided. Preferably, the container includes an outer shell defining an interior and having at least one opening for providing access to the interior. A lid is provided that incorporates a cap for providing access to the interior. At least one storage chamber is formed within the interior and is adapted to receive at least one item. An insulating material is disposed within the interior between the storage chamber and the outer shell. Additionally, a temperature-maintaining material is disposed within the interior between the storage chamber and the insulating material. So provided, the temperature of an item being transported within the container may be maintained, raised and or cooled as desired.

19 Claims, 6 Drawing Sheets

TRANSPORT CONTAINER

CROSS-REFERENCE TO RELATED APPLICATION

This application is a Continuation-in-Part Application, which is based on and claims priority to U.S. Patent Application entitled, "Re-Freezable Beverage Cooler," having Ser. No. 09/409,319, filed Sep. 30, 1999, now U.S. Pat. No. 6,216,487, issued on Apr. 17, 2001.

BACKGROUND OF THE INVENTION

1. Field of the Invention

The present invention generally relates to containers and, in particular, to containers that are configured to receive and store items so that the temperature of the item being transported may be maintained, raised and/or cooled as desired.

2. Description of the Related Art

Oftentimes, it is desirable to transport items, such as beverages, for example, in a portable container or cooler so that convenient access to the beverages is provided, such as while playing golf, attending sporting events, going to a beach, etc. Hereinbefore, such a container typically has been formed of either insulating material, for maintaining the temperature of previously chilled beverages, or a combination of insulating material and cooling material, such as blue ice, for instance, whereby the cooling material chills a beverage stored within the container and the insulating material tends to maintain the temperature of both the cooling material and the chilled beverages.

For example, U.S. Pat. No. 4,741,176, issued to Johnson, et al., discloses a beverage cooler, which includes a cylindrical freezer-pack insert to be placed into a cup, and a cover. In an embodiment of the Johnson device, the cylindrical freezer-pack insert includes removable sections to change its size, and removable plugs for putting coolant fluid into the removable sections. Since, however, the Johnson device is adapted for inserting within an individual cup, the device is limited for use in cooling one beverage at a time.

As another example, U. S. Pat. No. 4,295,345, issued to Atkinson, discloses a cooling container for canned beverages. The Atkinson device includes a reusable concave container for carrying and cooling canned beverages having a bottom section containing a plurality of cylindrical compartments, a top section containing corresponding compartments having a slow warming cooling gel in the upper end thereof, and a shoulder strap for carrying the container. While it is apparent that the Atkinson device addresses the problem of cooling multiple beverages simultaneously, it does not, however, provide for increased cooling efficiency of the beverages stored therein, as the cooling gel is stored only in the upper end of the container.

It also may be desirable to transport other items in a portable container. By way of example, various items, such as fluids, organs and/or other medical-related items, may require transport. Heretofore, these items typically have been transported within containers that are not specifically adapted for these items. This inadequacy also is prevalent in fields-other than the medical industry.

Therefore, there is a need for improved coolers which address these and/or other shortcomings of the prior art.

BRIEF SUMMARY OF THE INVENTION

Briefly stated, the present invention is directed to containers for transporting items. In this regard, embodiments of the invention may be construed as providing coolers. In a preferred embodiment, the cooler incorporates an outer shell defining an interior and includes at least one opening for providing access to the interior. A lid is provided that is configured to engage the outer shell. Preferably, the lid and outer shell are formed of substantially rigid material. At least one storage chamber is formed within the interior and is adapted to receive at least one item. Insulating material is disposed within the interior between the storage chamber and the outer shell, and a re-freezable material is disposed within the interior between the storage chamber and the insulating material.

Other embodiments of the invention may be construed as providing containers for transporting items. In a representative embodiment, the container includes an outer shell defining an interior and having at least one opening for providing access to the interior. A lid is provided that incorporates a cap for providing access to the interior. At least one storage chamber is formed within the interior and is adapted to receive at least one item. An insulating material is disposed within the interior between the storage chamber and the outer shell. Additionally, a temperature maintaining material is disposed within the interior between the storage chamber and the insulating material. So provided, the temperature of an item being transported within the container may be maintained, raised and or cooled as desired.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE SEVERAL VIEW OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Figure 1:
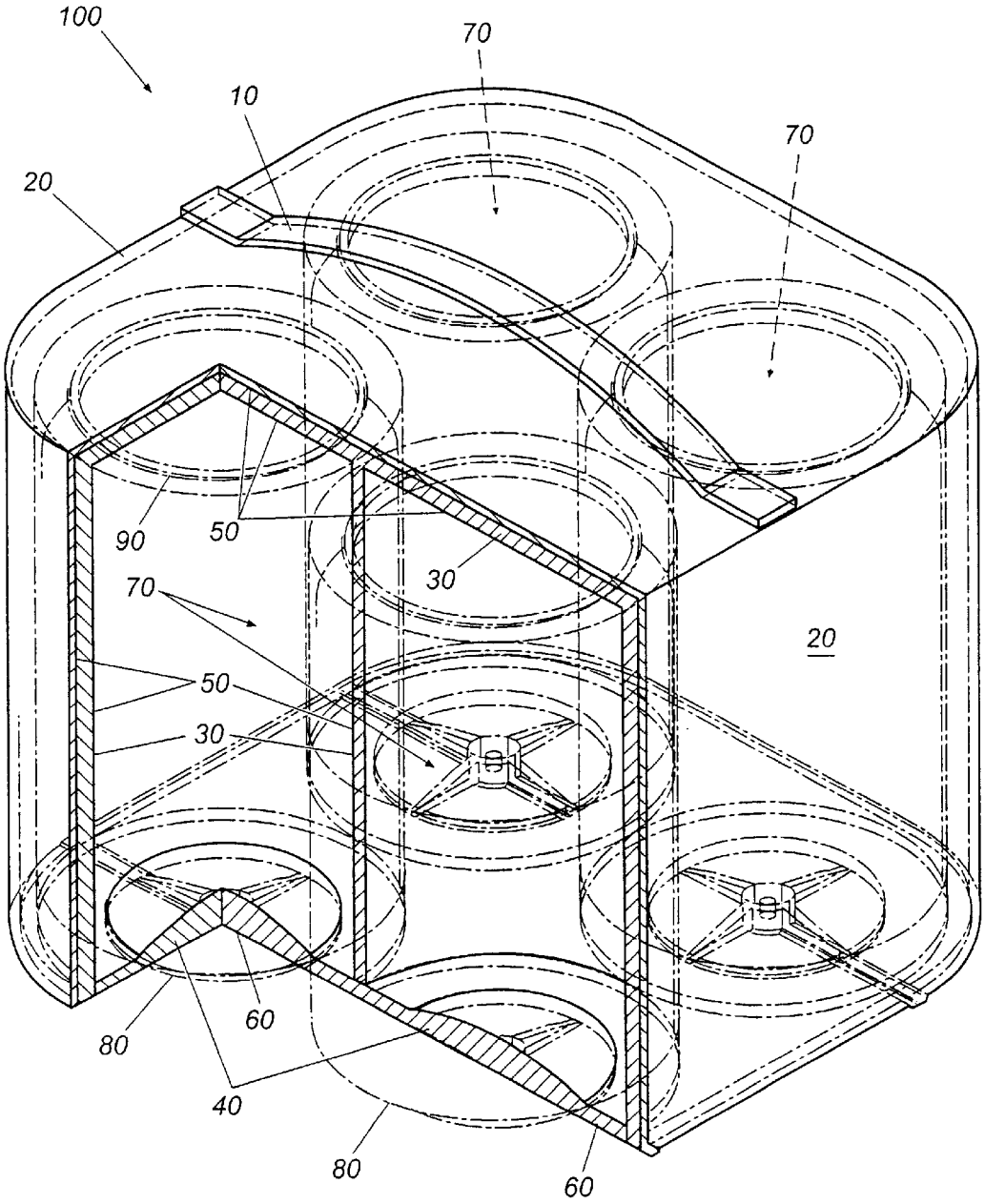
FIG. 1 is a partially cut-away perspective view of a preferred embodiment of the present invention with representative beverage containers shown in phantom lines.
Figure 2:
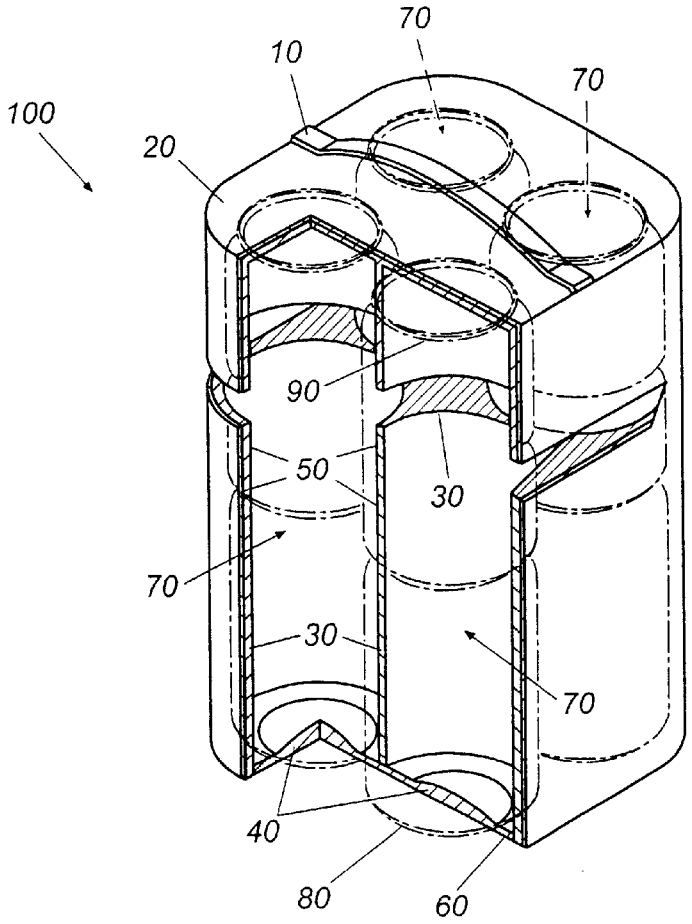
FIG. 2 is a partially cut-away, perspective view of an alternative embodiment of the present invention with representative beverage containers shown in phantom lines.
Figure 3:
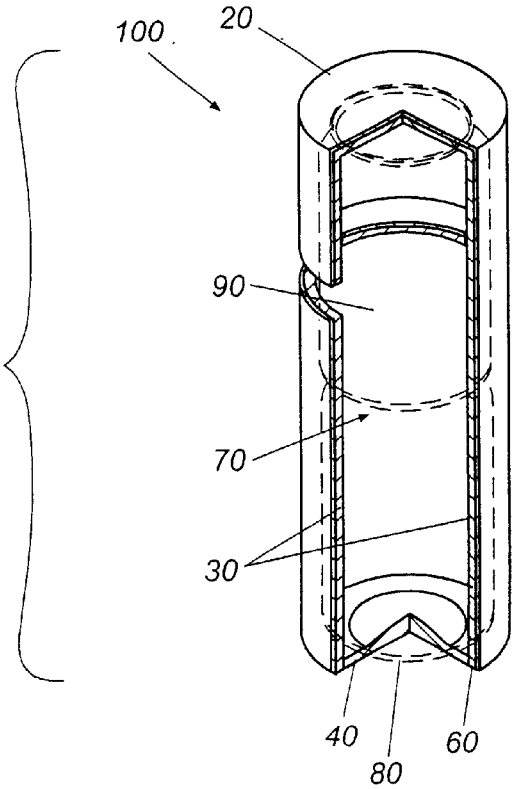
FIG. 3 is a partially cut-away, perspective view of an alternative embodiment of the present invention with representative beverage containers shown in phantom lines.
Figure 4:
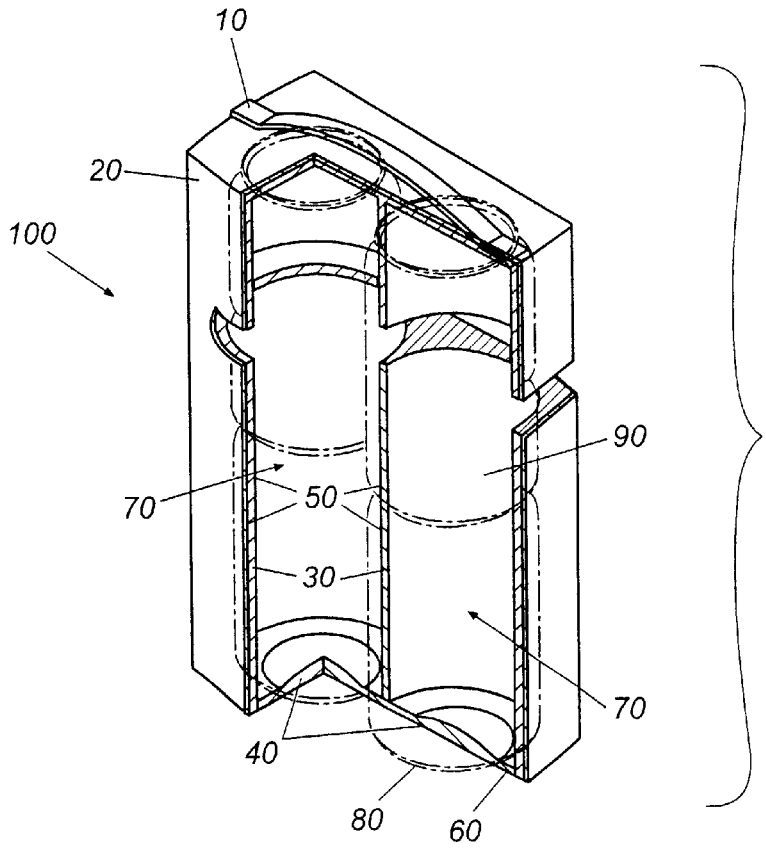
FIG. 4 is a partially cut-away, perspective view of an alternative embodiment of the present invention with representative beverage containers shown in phantom lines.
Figure 5:
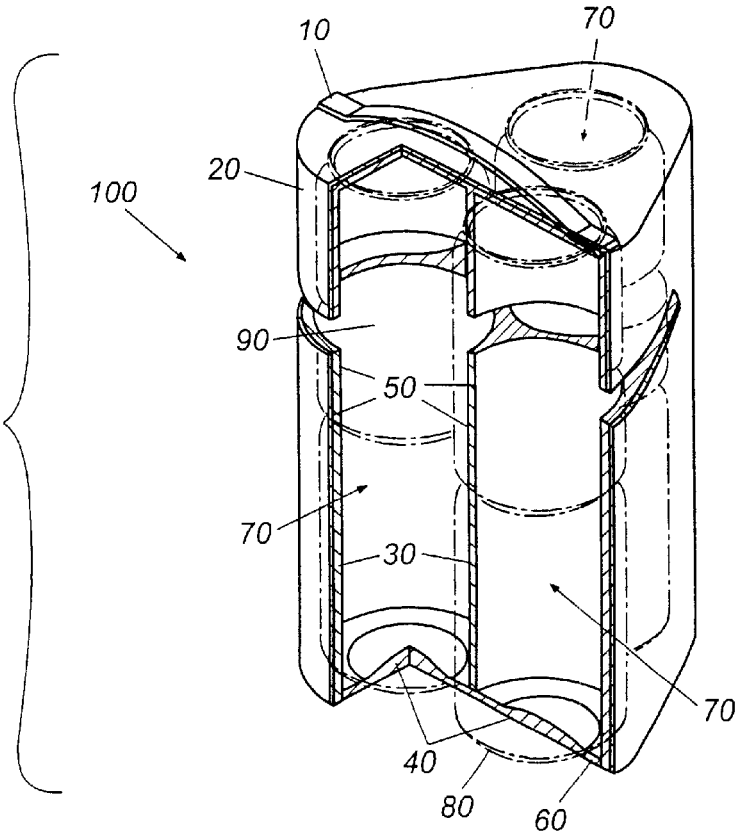
FIG. 5 is a partially cut-away, perspective view of an alternative embodiment of the present invention with representative beverage containers shown in phantom lines.

Reference will now be made in detail to the drawings, wherein like reference numerals indicate like parts throughout the several views. As shown in FIG. 1, a preferred embodiment of the cooler 100 of the present invention incorporates an outer shell 20, preferably formed of a durable material, such as molded plastic, or other suitable materials, and which defines an interior. Preferably, one or more storage chambers 70 are provided within the interior. Storage chambers 70 preferably are adapted to receive one or more beverage containers 90, such as conventional cans or bottles, with the cooler being constructed so as to chill the beverages containers 90, and/or maintain the beverages of the containers 90 at a suitable chilled temperature, as described hereinafter.

Access to the storage chamber(s) 70, such as for the insertion and/or removal of beverage containers 90, preferably is facilitated by one or more caps 80 which removably engage the shell 20. For example, in the preferred embodiment depicted in FIG. 1, a plurality of caps 80 are provided along a lower surface of the shell 20, with each of the caps being constructed as a "screw-off" cap so that engagement of each of the caps with the shell is facilitated by rotating the cap relative to the shell. However, in other embodiments, engagement of the cap and shell may be facilitated by a friction fit, or other suitable means.

Preferably, storage chamber(s) 70 are defined by inner walls of a re-freezable material chamber 50 which is adapted to receive and retain a quantity of re-freezable material 30. Preferably, the re-freezable material chamber 50 is adapted to conform to the exterior surface of a beverage container 90 and, therefore, fills the interstices formed between the various containers. Preferably, in embodiments which are adapted for receiving one beverage container within each storage chamber, each beverage container is surrounded and engaged by the inner wall of the re-freezable material chamber, i.e., on all of its sides and its top.

An insulation chamber 40 preferably is provided between the re-freezable material chamber 50 and the shell 20. Preferably, insulation chamber 40 is filled with an efficient insulating material 60, such as polyurethane foam or other suitable material. So configured, each beverage container inserted within a storage chamber 70 is encased by a layer of re-freezable material, as well as within a layer of insulation for maintaining the temperature of the re-freezable material at a suitable temperature.

Additionally, cooler 100 may be provided with a handle 10 so that the cooler is easily transportable. The handle may be formed of numerous suitable materials, such as plastic or leather, for instance, and may be fastened to the cooler in any conventional manner so that the weight of the cooler and any beverage container stored therein does not cause the handle to separate and detach from the shell 20.

As depicted in FIGS. 2–5, various numbers and arrangements of storage containers 70 may be provided for storing and cooling various numbers of beverage containers 90.

Figure 6:
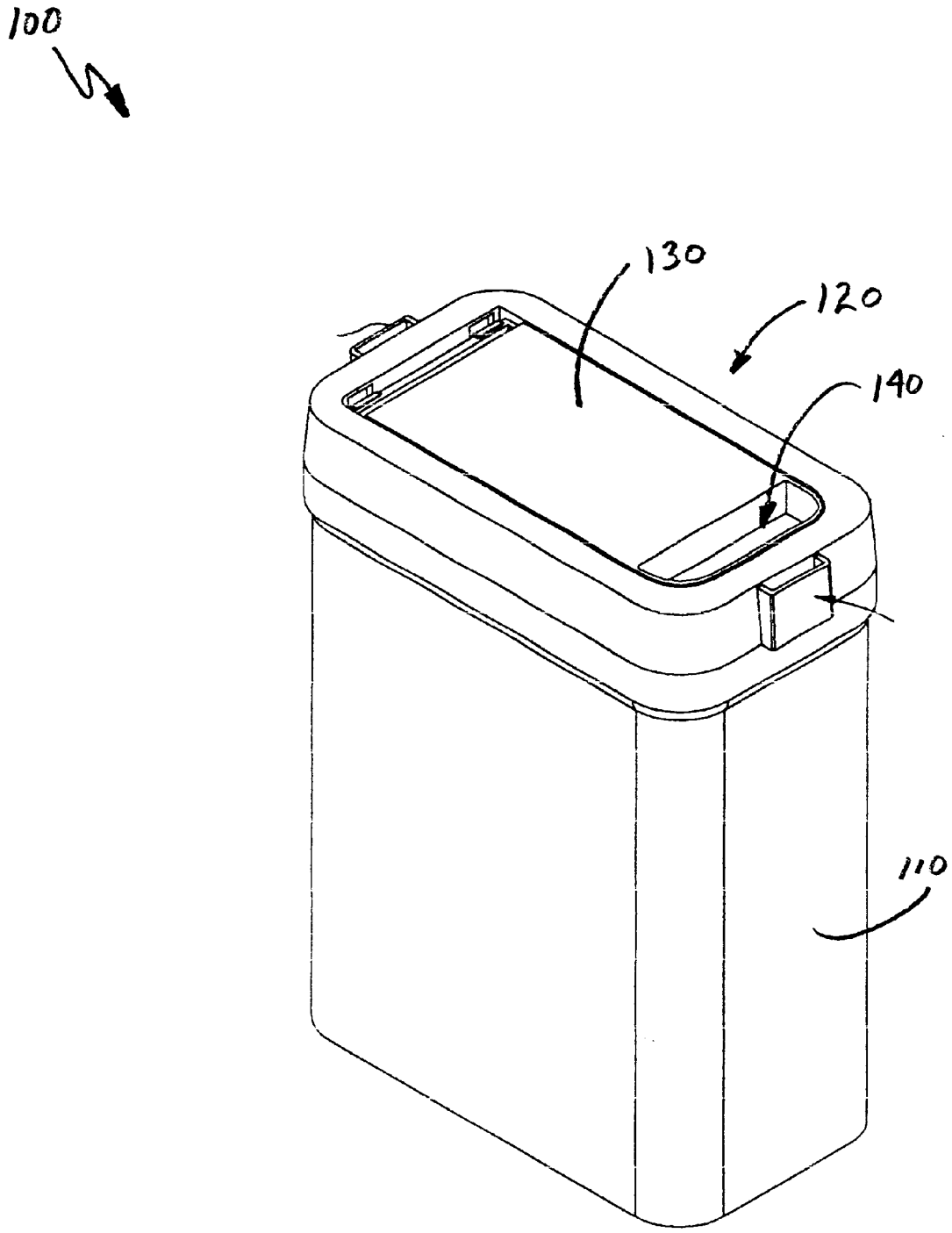
FIG. 6 is a perspective view of an alternative embodiment of the present invention.

Reference will now be made to FIGS. 6–9, which depict a representative alternative embodiment of the cooler of the present invention. As shown in FIG. 6, cooler 100 includes an outer shell 110 and a lid assembly 120. As described in greater detail hereinafter, shell 110 and lid 120 cooperate to form a protective enclosure for transporting and/or storing items placed within an interior of the container. Preferably, shell 110 is formed of a substantially rigid material that is adapted for protecting items placed within the container. Additionally, lid 120 preferably is formed, at least partially, of substantially rigid material.

As shown in FIG. 6, lid 120 incorporates a cap or door 130 that is adapted to alternately provide and deny user access to the interior of the container. In the embodiment depicted in FIG. 6, door 130 includes a recess 140 that is adapted to receive the fingers of a user so that the user may urge the door from its closed to its open position.

Figure 7:
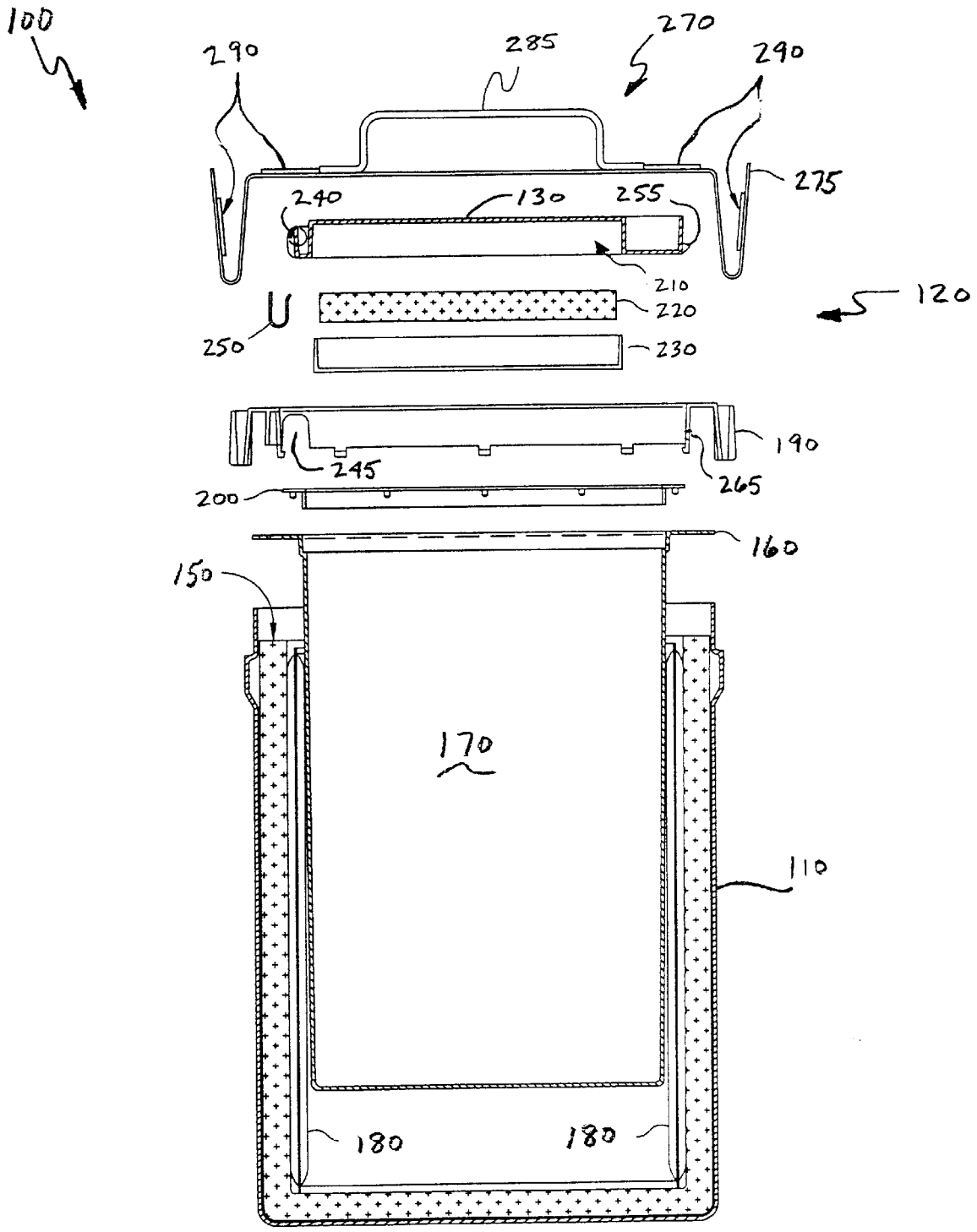
FIG. 7 is a partially exploded, cut-away, side view of the embodiment depicted i n FIG. 6.

Referring now to FIG. 7, assembly of the container 100 will be described in greater detail. As shown in FIG. 7, a layer(s) of insulation 150 preferably is disposed within the interior of the container. In some embodiments, insulation 150 is provided adjacent an interior surface of the outer shell. An insert 160 is adapted to be received within the interior. The insert defines a storage chamber 170, which is adapted to receive one or more items. Re-freezable material 180 preferably is disposed between an exterior surface of the insert and the layer(s) of insulation 150. Engagement of the insert with the outer shell also may tend to retain the insulation 150 and re-freezable material 180 in position within the interior.

As shown in greater detail in FIG. 7, lid 120 includes a top 190 as well as door 130. Top 190 is adapted to engage the outer shell so as to provide a mounting platform for the door. In some embodiments, a gasket 200 is provided between the top and the insert.

Insulation also may be provided within the door. More specifically, the door may be formed with an insulation-receiving recess 210 that is sized and shaped for receiving a layer(s) of insulation 220. In order to maintain the insulation 220 in position relative to the door, a door insulation retainer 230 may be provided that is adapted to securely engage the door.

In order to facilitate moving the door from its closed position (depicted in FIG. 6) to its open position (depicted in FIG. 8), pivots 240 of the door are received within orifices 245 so as to enable pivoting of the door about the pivots. In some embodiments, a spring 250 is provided for securing the door in the closed position. In particular, spring 250 urges a latch 255 of the door toward engagement with a recess 265. Thus, when the latch and recess are aligned, the latch forms an interference fit, thereby tending to maintain the door in its closed position.

As shown in FIG. 7, a handle assembly may be provided for facilitating transport of the container. Preferably, handle assembly 270 includes a strap portion 275. Each end of the strap portion preferably is adapted to engage a strap guide 280 of the container, which may be formed on the lid, for example. In some embodiments, a handle may be provided at an intermediate portion of the handle assembly. In these embodiments, the handle 285 preferably is formed of a substantially rigid material and is mounted to the strap so as to provide a portion of the handle assembly that is readily suited for grasping by the hand of a user. In the embodiment depicted in FIG. 7, ends of the strap are secured to the strap guides by hook and loop material 290 although, in other embodiments, various other mechanisms for securing the strap to the container may be utilized.

Figure 9:
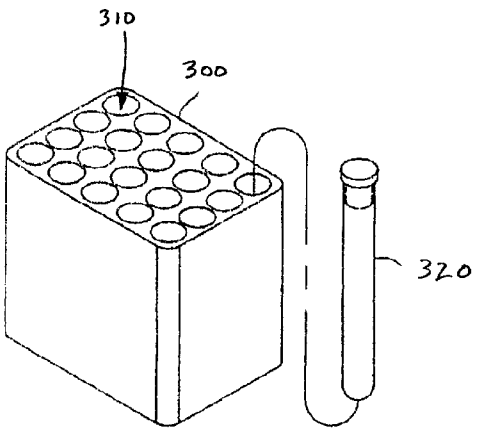
FIG. 9 is a preferred embodiment of the item retainer, which may be utilized in the container of FIGS. 6–8.
Figure 8:
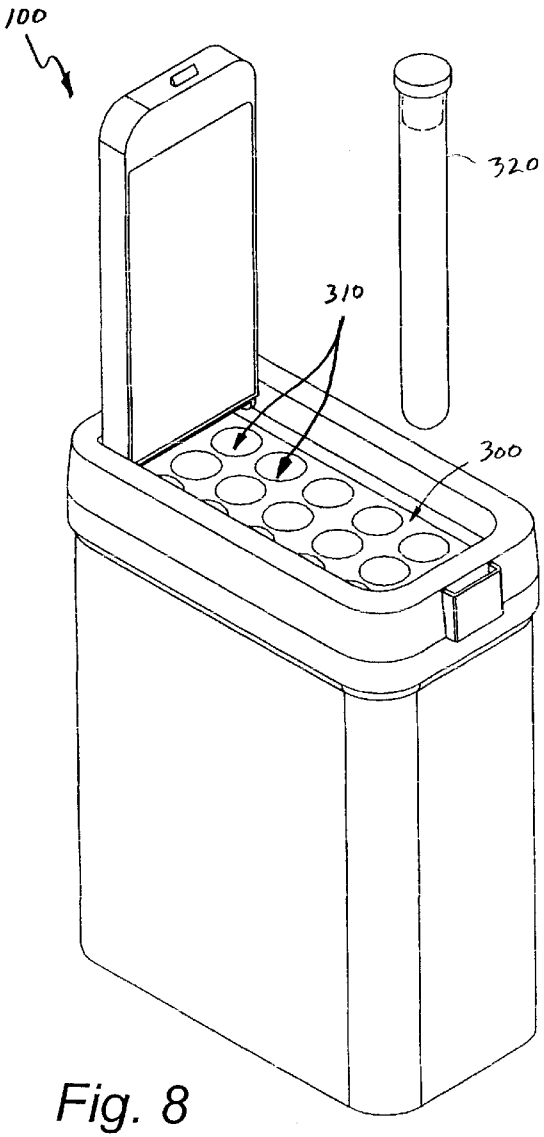
FIG. 8 is a perspective view of the embodiment depicted in FIGS. 6 and 7, showing the lid in an open position.

As shown in FIGS. 8 and 9, the container 100 may be configured with an item-receiving retainer 300. Item-receiving retainer 300 defines one or more item-receiving cavities 310 that may be specifically sized and shaped to conform to an exterior surface of an item to be received therein. For example, the item-receiving cavities 310 depicted in FIG. 8 are each specifically configured to receive a test tube or vile 320. Preferably, an exterior surface of the item-receiving retainer is adapted to engage an interior surface of the insert and is configured so that cooperation of the lid and the outer shell maintains the item-receiving retainer within the storage chamber.

In addition to substantially maintaining relative positions of items stored within the container, the material of the item-receiving retainer may be suitably selected so as to provide shock absorbing. In these embodiments, such as those embodiments formed of a foamed material, for example, the item-receiving retainer may reduce the tendency of an item to break within the container.

In some embodiments, various configurations of item-receiving retainers may be provided. More specifically, multiple item-receiving retainers may be provide with a given container, with each item-receiving retainer being adapted to receive various configurations of items for storage within the container. So provided, the container may be adapted so as to specifically accommodate transporting and cooling of particularly sized and shaped items.

The foregoing description has been presented for purposes of illustration and description. It is not intended to be exhaustive or to limit the invention to the precise forms disclosed. Modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. By way of example, the refreezable material may be generally be considered a temperature-maintaining material. As such, the temperature maintaining material of the present invention may be configured, in some embodiments, as a material that is able to retain heat. So provided, these embodiments may be suited for transporting items that are to be maintained at warmer temperatures. All such modifications and variations, are within the scope of the invention as determined by the appended claims when interpreted in accordance with the breadth to which they are fairly and legally entitled.

What is claimed is:

1. A cooler for transporting and cooling items, said cooler comprising:

an outer shell defining an interior and having at least one opening for providing access to said interior, said outer shell being formed of a substantially rigid material for protecting items stored therein;

a lid configured to engage said outer shell, said lid being formed of a substantially rigid material, said lid defining a lid opening and having a cap, said cap movably engaging said lid, said cap being movable between an open position and a closed position, in said closed position said cap engaging said lid opening such that said lid and said outer shell encase said interior for protecting items stored therein, in said open position said lid opening providing access to said interior;

at least one storage chamber formed within said interior and communicating with said at least one opening, said storage chamber adapted to receive at least one item;

an insulating material disposed within said interior between said storage chamber and said outer shell; and a re-freezable material disposed within said interior between said storage chamber and said insulating material.

2. The cooler of claim 1, further comprising:

an insert defining said at least one storage chamber, said insert being sized and shaped to be received, at least partially, within said interior via said opening, said insert being configured such that at least a portion of an exterior surface of said insert is engaged by said re-freezable material.

3. The cooler of claim 1, wherein said re-freezable material is disposed and is configured to conform about the exterior of the item inserted within said storage chamber.

4. The cooler of claim 1, further comprising:

an item retainer being sized and shaped to be received, at least partially, within said storage chamber via said opening, said item retainer defining at least one item-receiving cavity such that at least a portion of an item to be stored within said container is received within a corresponding item-receiving cavity.

5. The cooler of claim 1, further comprising:

a plurality of item retainers, each of said item retainers being sized and shaped to be received, at least partially, within said storage chamber via said opening, each of said item retainers defining at least one item-receiving cavity such that at least a portion of an item to be stored within said container is received within a corresponding item-receiving cavity, each of said item retainers being configured to receive items of different exterior shapes within their respective item-receiving cavities.

6. The cooler of claim 1, wherein said re-freezable material is configured for freezing while being maintained as an integral portion of said cooler.

7. The cooler of claim 1, further comprising:

a handle assembly configured to engage said lid for enabling transport of said container.

8. The cooler of claim 1, further comprising:

means for protecting items stored within said container.

9. The cooler of claim 4, wherein an exterior surface of said item retainer engages an interior surface of said insert.

10. The cooler of claim 4, wherein a surface defining said item-receiving cavity is configured to substantially conform to at least a portion of the exterior of the item inserted therein.

11. The cooler of claim 5, wherein engagement of said lid with said outer shell retains said item retainer within said storage chamber.

12. The cooler of claim 7, wherein said handle assembly includes a strap portion and a handle portion, said strap portion having first and second ends, said ends being configured to engage said lid, said handle being arranged at in intermediate portion along the length of said strap portion, said handle being configured to be grasped by a user for transporting said container.

13. The cooler of claim 8, wherein said means for protecting items includes means for cushioning the items such that a tendency for the items to break is reduced.

14. A transport container comprising:

an outer shell defining an interior and having at least one opening for providing access to said interior, said outer shell being formed of a substantially rigid material for protecting items stored therein;

a lid configured to engage said outer shell, said lid being formed of a substantially rigid material, said lid defining a lid opening and having a cap, said cap movably engaging said lid, said cap being movable between an open position and a closed position, in said closed position said cap engaging said lid opening such that said lid and said outer shell encase said interior for protecting items stored therein, in said open position said lid opening providing access to said interior;

at least one storage chamber formed within said interior and communicating with said at least one opening, said storage chamber adapted to receive at least one item;

an insulating material disposed within said interior between said storage chamber and said outer shell;

a temperature-maintaining material disposed within said interior between said storage chamber and said insulating material; and an item retainer received within said storage chamber, said item retainer defining at least one item-receiving cavity such that at least a portion of an item to be stored within said container is received within a corresponding item-receiving cavity.

15. The cooler of claim 14, further comprising:

an insert defining said at least one storage chamber, said insert being sized and shaped to be received, at least partially, within said interior via said opening, said insert being configured such that at least a portion of an exterior surface of said insert is engaged by said temperature-maintaining material and at least a portion of an interior surface of said insert engages said item retainer.

16. The cooler of claim 14, wherein said temperature-maintaining material is a re-freezable material configured for freezing while being maintained as an integral portion of said cooler.

17. The cooler of claim 14, wherein said cap has a latch and said lid defines a latch-receiving recess, said cooler further comprising:

a spring disposed between said lid and said cap, said spring configured to urge said latch into engagement with said latch-receiving recess such that said cap is substantially retained in said closed position.

18. The cooler of claim 14, further comprising:

means for protecting items stored within said container.

19. The cooler of claim 4, wherein an exterior surface of said item retainer engages an interior surface of said insert.

* * * * *